United States Patent [19]

Surti

[11] Patent Number: 4,820,067

[45] **Date of Patent: * Apr. 11, 1989**

[54] RIBBON CARTRIDGE

[76] Inventor: Tyrone N. Surti, 424 Harding Industrial Dr., Nashville, Tenn. 37211

[ * ] Notice: The portion of the term of this patent subsequent to Dec. 16, 2003 has been disclaimed.

[21] Appl. No.: 59,597

[22] Filed: Jun. 8, 1987

Related U.S. Application Data

[63] Continuation-in-part of Ser. No. 855,072, Apr. 22, 1986, Pat. No. 4,685,817, Continuation-in-part of Ser. No. 725,931, Apr. 22, 1985, Pat. No. 4,629,346.

[51] Int. Cl.[4] ..... B41J 32/00

[52] U.S. Cl. ..... 400/208; 400/235; 400/248

[58] Field of Search ..... 400/207, 208, 208.1, 400/223, 235, 236, 248, 194, 195, 196, 196.1; 226/170, 171, 172; 242/192

[56] References Cited

U.S. PATENT DOCUMENTS

| | | | |
|---|---|---|---|
| 4,333,618 | 6/1982 | Seaman | 242/192 |
| 4,496,255 | 1/1985 | Meintrup et al. | 400/208 |
| 4,629,346 | 12/1986 | Surti | 400/223 X |
| 4,685,817 | 8/1987 | Surti | 400/208 |

FOREIGN PATENT DOCUMENTS

| | | | |
|---|---|---|---|
| 33974 | 4/1981 | Japan | 400/208.1 |
| 162682 | 12/1981 | Japan | 400/208 |

*Primary Examiner*—Charles Pearson
*Attorney, Agent, or Firm*—C. A. Phillips

[57] ABSTRACT

A printer ribbon cartridge of the type employing two ribbon spools mounted in spaced relation in the cavity formed in the case of the cartridge. In this one, the ribbon is driven by a belt engaging the spools and, in turn, the belt is engaged by both of two alternately driven drive rollers. Alignment and guide devices keep the center lines of the ribbon and belt in coincident alignment and also keep the edges of the ribbon from frictional engagement with the top and bottom of the case.

9 Claims, 6 Drawing Sheets

RIBBON CARTRIDGE

Cross-Reference of Related Application

This invention is a continuation-in-part of application Ser. No. 06/855,072, filed Apr. 22, 1986, entitled "Ribbon Cartridge," now U.S. Pat. No. 4,685,817, issued Aug. 11, 1987, which is a continuation-in-part of application Ser. No. 06/725,931, filed Apr. 22, 1985, entitled "Printer Ribbon Cassette," now U.S. Pat. No. 4,629,346, issued Dec. 16, 1986.

TECHNICAL FIELD

This invention relates generally to printing ribbon holders and particularly to belt driven reel-to-reel type ribbon cartridges having guides for guiding the ribbon and belt in a predetermined aligned path.

BACKGROUND OF THE INVENTION

Printers for printing out the outputs of computers are understandably varied in configuration. Two very popular groups, exemplified by NEC Models 2000/3500/8000 and Diablo HyType II, are of the daisy wheel type, printing a whole character with each stoke of printer operation. These printers employ a ribbon cartridge wherein a ribbon wound on and between two spools is impacted by a character print element of the printer. Cartridge configurations for these printers are illustrated by Meintrup et al. U.S. Pat. No. 4,496,255, Shapiro U.S. Pat. No. 4,533,266 and Kano U.S. Pat. No. 4,544,291. A principal characteristic of such cartridges is that spaced capstan drives, alternately driven through opposite sides of the cartridge by a rotary drive member of a host printer. One of the capstan drives drives a ribbon in one direction, wherein a top region of the ribbon is utilized in printing, and the other capstan drive drives the ribbon in the opposite direction and a bottom region of the ribbon is utilized. Each of the capstan drives consists of a drive roller and a pinch roller, and each capstan drive is associated with one of two spools of the cartridge. A belt is coupled between the driven roller and its associated spool, driving this spool, as a take-up spool, in a direction to receive the ribbon. This belt is positioned on the outside of the cartirdge, connecting between pulleys on shafts of the drive roller and spool. In order to switch directions of drive, the cartridge is turned over and the belt is removed from pulleys on one side of the cartridge and placed around pulleys on the opposite side.

The belt and pulley arrangement discussed is an obvious disadvantage, both from the point of view of inconvenience and the variable tension effected upon the take-up spool as the amount of ribbon on it changes. Perhaps in recognition of the most blatant of these, the inconvenience, Meintrup suggests that an internal belt might be employed and cites a data tape cartridge manufactured by the 3M Company as providing such. This cartridge or cassette is illustrated in von Behren U.S. Pat. No. 3,692,255, and a ribbon cartridge counterpart of it is illustrated in Sasaki U.S. Pat. No. 4,528,572. upon examination of these references, it appears that both employ a single, centrally positioned drive member and thus are employable only with drive units, tapes drives, or printer drives adapted to interface with a central position on a cartridge and not one where separate, spaced capstan drives are employed as required by the printers referred to above. Clearly, neither of these patents provides a teaching as to how one would employ an internal belt in a ribbon cartridge where the drive positions are spaced apart as in the class of cartridge we are concerned with here. In contrast, the inapplicability is manifest and is obvious from the fact that if a belt were stretched between the capstan drives of Meintrup, with an idler symmetrically positioned, e.g., where the drive roller is positioned in the case of Sesaki, the ribbon would be driven by the belt in one direction and the ribbon spool in an opposite direction, an inoperative condition.

In addition to the belt problem, another problem is that of generally providing needed tension on the ribbon of a dual capstan system. Ribbon tension is particularly necessary in the region where the print elements of the printer impact the ribbon to make an imprint on paper. It is important that the ribbon be held taut and constantly so. If there is insufficient tension, the ribbon will tend to drag on the paper and smudge it. If the tension becomes too great, there is a danger of breakage of a ribbon as a printing element impacts on it. Currently available cartridges constructed in accordance with the prior art simply reply upon mechanical drag brought about by the frictional state of the bearing surfaces of a pinch roller, a drive roller, and a spool to provide proper tension. Unfortunately, these frictional factors vary, this variance being paritcularly commercially affected by constantly varying spool sizes as ribbon is fed to and drawn off of the spools. In any event, there is a substantial lack of consistency of ribbon tension.

A still further matter of concern with respect to the merit of ribbon cartridges is that of rate of use of ribbon. Ideally, the ink in the vicinity of an impact by a printing element will be completely utilized but not to the extent that a portion of a character being printed will receive insufficient ink. Pertinently, the rate of ribbon usage is a function of the speed of the rotating drive of the printer and the translation of this speed to a final ribbon drive speed, the latter being a function of the drive mechanism of the cartridge. Since the drive speed is thus fixed by a printer manufacturer, it is up to the ribbon cartridge manufacturer to provide a cartridge which will provide an optimum rate of ribbon advancement for the drive speed at hand. Unfortunately, it appears that because of certain structural limitations imposed by the mechanisms employed in prior art ribbon cartridges, they effect a higher rate of ribbon travel than is actually necessary to provide good print quality. Specifically, it appears that this is the result of employing a direct capstan drive of ribbon, which in turn has necessitated the employment of toothed surfaces to obtain sufficient grip on a ribbon to reliably advance it. This in turn has resulted in an excessive effective diameter of the drive roller, resulting in an excessive effective rate of ribbon advancement.

Further, in addition to the belt problem, the problem of providing needed tension on the ribbon of a dual capstan system, and the problem associated with the rate of use of ribbon, still another problem which merits attention is the need (in internally driven belt systems using spaced spools and capstans with the belt in contact with the ribbon on the spools) for providing alignment and guide means for aligning the center line of the belt and ribbon in coincident relation and for guiding the ribbon in a predetermined path while preventing the edges of the ribbon from undesirable frictional contact with the internal surfaces of the top and bottom of the ribbon casing and also preventing the belt from "riding" across the surface of the ribbon between the edges thereof during the movement of the ribbon between the spools.

SUMMARY OF THE INVENTION

In accordance with this invention, alternately, one of two drive rollers, driven by a printer, drives an internally located belt, and this belt engages the ribbon at two locations where it is wound on the spools. It further engages an idler roller, and it engages the other (then undriven) drive roller. The ribbon is not engaged by a drive roller either directly or through the thickness of the belt. The idler roller is positioned to hold the belt against the ribbon where it is wound on ribbon spools. Alignment and guide devices are provided whereby the center line of the belt and ribbon is maintained in alignment in a common plane to prevent "riding" of the belt across the ribbon surface and to maintain the edges of the ribbon in spaced relation with the internal surfaces of the casing to prevent undue frictional engagement therebetween. The devices also maintain the belt and the ribbon in spaced relation as the belt is rotated around the drive rollers.

As a further feature of this invention, the drive roller would be made with a generally even cylindrical contour. By this approach, the effective diameter of the roller is reduced, enabling a lower ribbon drive speed, which results in a significant economy of ribbon usage.

DETAILED DESCRIPTION OF THE DRAWINGS

Figure 4:
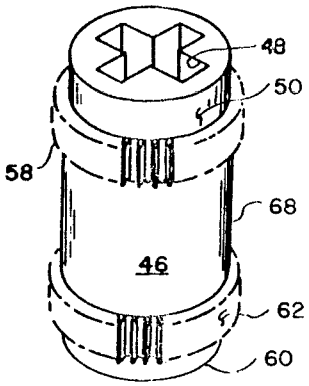
FIG. 4 is an enlarged pictorial view of a capstan or drive gear employable in the present invention.

Referring to the drawings, a ribbon case 10 houses in cavity 12 transport and storage means for a printing ribbon 14. Case 10 includes lower and upper broad sides 11 and 13, front and rear opposite sides 9 and 15, and first and second opposite sides 17 and 19. Ribbon 14 is stored on and winds between spools 16 and 18 and is guided in a path which ultimately places it between ribbon guides 20 and 22. Guide 20 is supported on the front side of case 10 by arm 24, and guide 22 is supported on this side of the case by oppositely supported arm 26. A print head from a host printer (not shown) effects printing, for example, on paper by a print character being impacted through a generally central region of ribbon 14 between guides 20 and 22.

Ribbon spools 16 and 18 are conventionally supported by stub axles 28 and 38 extending from broad side 11 of case 10.

Ridge members 90, 92, 94, and 96 form spaced supports to provide stability for the assembled cartridge. When in place, cover 32 is attached via pins (not shown) which extend into a plurality of openings 71 spaced about the cartridge.

Each of drive rollers **46*a* and 46*b* is illustrated by an identical drive roller 46 shown in FIG. 4, and the latter designation may refer to either of the two former ones. It includes a cross-shaped opening 48 in each end which fits over a flat key drive (not shown) of a printer, the flat key mating with one of the crossed regions of opening 48. A bearing region 50 of each drive roller 46*a* and 46*b* fits within mating openings 52 in upper broad side 13, and a like region 60 of drive rollers 46*a* and 46*b* fits in mating openings 54 of lower broad sides 11. An enlarged (in diameter) collar region 58 effects axial restraint of drive roller 46 (46*a* or 46*b*) in one side 13 of case 10. A simiar collar 62 of the drive rollers provides a shoulder bearing for axial positioning of bearing region 60 of drive rollers 46*a* and 46*b* within openings 54 of broad side cover 11 of case 10**.

Belt 70 (see dotted lines) interconnects drive rollers **46*a* and 46*b* and effects a positive drive between the drive roller being driven by the printer and ribbon 14. Belt 70 is held in tension by an idler roller 72, the latter being positioned to provide a belt path which holds belt 70 against ribbon 14 where it is wound on spools 16 and 18. Roller 72 is mounted on a stub axle 71 which extends upwardly from broad side 11. Collars 58 and 62 on either side of a flat pulley region 68 of each drive roller assure that belt 70 will be generally held into alignment with ribbon 14**. Close alignment is provided by alignment and guide means discussed hereinbelow.

Figure 3:
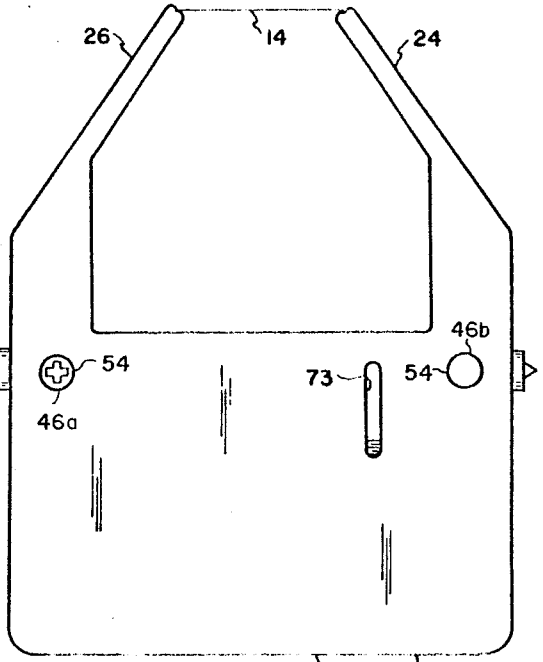
FIG. 3 is a bottom plan view of the cassette shown in FIG. 1.
Figure 2:
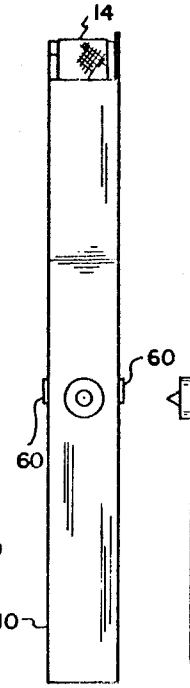
FIG. 2 is a side view of the cassette shown in FIG. 1.

Idler roller 72 is generally positioned toward a rear side of case 10 along a line bisecting case 10 between the axis of spools 16 and 18, this line being generally normal to the linear portion of travbel of belt 70. While idler roller 72 is fixedly mounted as shown, it may be spring loaded to permit travel to a selected ribbon region, for example, along the locational line just referred to. In this case, belt 70 may be essentially non-stretchable and tension described above would be provided by the spring biasing of idler roller 72. Openings 73 (FIG. 3) provide a view of the state of ribbon on one of the spools, there being an opening 73 in each of the two sides of case 10 such that one spool is observable from one side and the other from the other side.

Figure 1:
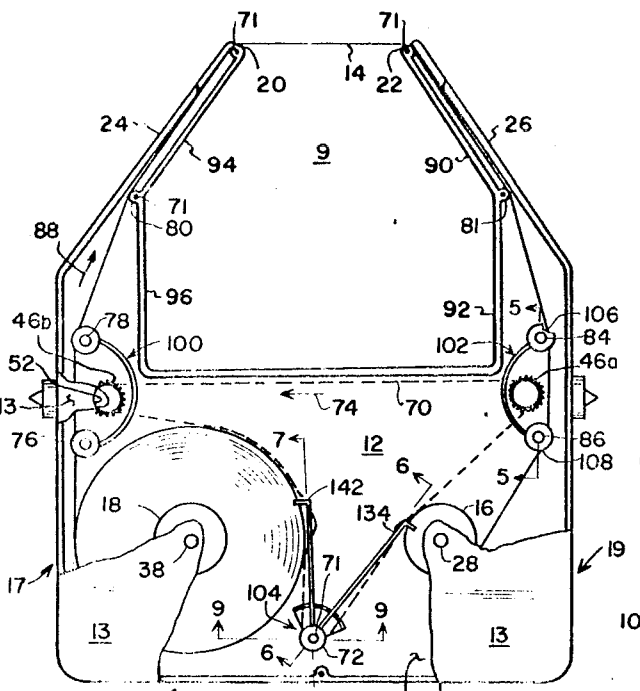
FIG. 1 is a top plan view, partially broken away, of an embodiment of a ribbon cassette constructed in accordance with the present invention.

To provide a means for closely aligning the belt and ribbon so that the center line of the ribbon and the belt is in a common plane and to provide for maintaining the edges of the ribbon in spaced relation with the broad sides 11 and 13 of case 10, alignment and guide means is provided and is comprised of members 100, 102, and 104 which are assembled in cavity 12 as shown in FIG. 1. Alignment member 100 is mounted on posts 76 and 78, alignment member 102 is mounted on posts 84 and 86, and alignment member 104 is mounted on idler support post 71.

Figure 5:
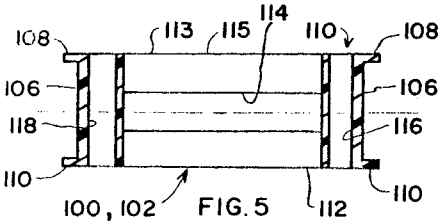
FIG. 5 is a sectional elevational view of the drive roller ribbon and belt guide taken along line 5—5 of FIG. 1.

Alignment members 100 and 102 are identical and include a pair of spaced hollow posts 106 (FIG. 5) having flanges 108 and 110 on opposite sides 112 and 115 thereof. Hollow posts 106 are joined by an arcuate section 113 having an elongated slot 114 therein. The pair of similar alignment members are assembled with the openings 116 and 118 of posts 106 of member 100 mounted around posts 76 and 78, respectively, and with the openings 116 and 118 of member 102 mounted around guide posts 84 and 86, respectively.

Figure 8:
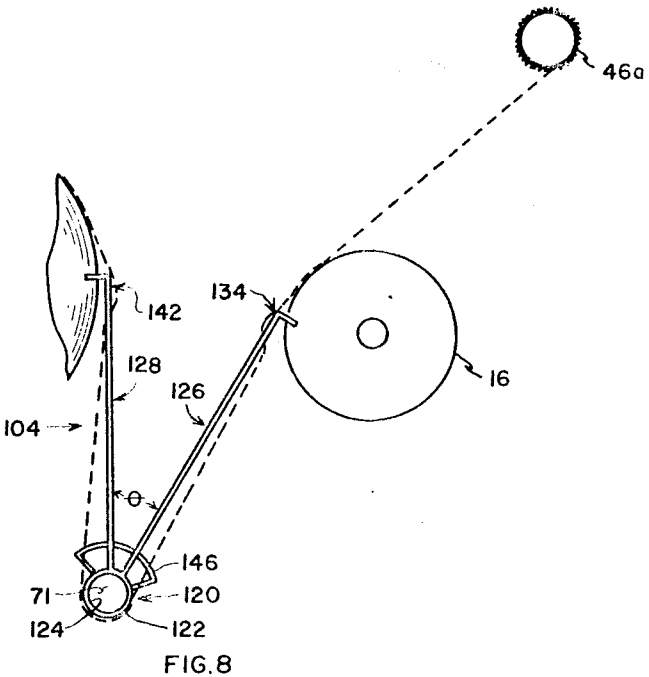
FIG. 8 is an enlarged, top fragmentary view of the device of the present invention illustrating the relationship of the ribbon, one spool, and an arm of the idler roller alignment and guide device.
Figure 6:
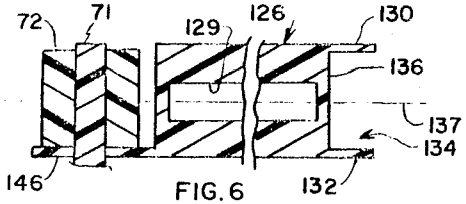
FIG. 6 is a sectional elevational view of the idler roller ribbon and belt guide taken along line 6—6 of FIG. 1.
Figure 7:
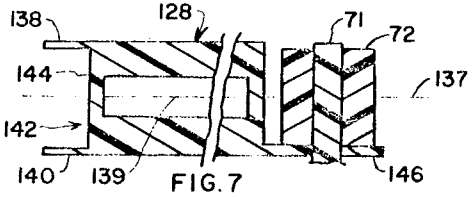
FIG. 7 is a sectional elevational view of the idler roller ribbon and belt guide taken along line 7—7 of FIG. 1.
Figure 9:
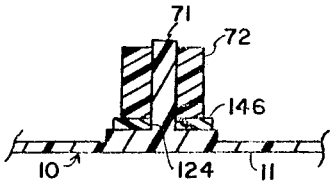
FIG. 9 is a sectional view taken along line 9—9 of FIG. 1 illustrating the mounting of the idler roller ribbon and belt guide in the cartridge body.

Alignment member 104 is provided at end 120 thereof (FIG. 8) with a circular body portion 122 having an opening 124 therethrough. A pair of spaced arms 126 and 128 extend radially from portion 122. The arms are identical and are spaced substantially 36° apart. Arm 126 is provided (FIG. 6) with an elongated slot 129 defining a belt alignment guide and with flanges 130 and 132 at the curved distal end 134 thereof to form a ribbon alignment guide 136. The center line 137 of the belt and ribbon guides are coincident. Arm 128 is provided (FIG. 7) with an elongated slot 139 defining a belt alignment guide and with flanges 138 and 140 at the distal end 142 thereof to form a ribbon guide 144. Both arms are identical; however, the distal ends of the arms extend in opposite directions. A ribbed support member 146 is provided at end 120 of member 104 for support of arms 126 and 128. Alignment and guide member 104 is assembled in cavity 12 of casing 10 with idler support 71 extending through opening 124 (as shown in FIG. 9). The curved ends 134 and 142, respectively (FIG. 1), are disposed in engagement with the ribbon on spools 16 and 18 so that the ribbon passes through alignment guides 136 and 144 to maintain the center line of the belt and ribbon in a common plane and to also maintain the edges of the ribbon from excessive frictional contact with the inner surfaces of broad faces 11 and 32 of casing 10. It is readily seen that by maintaining arms 126 and 128 in a predetermined spaced relation (typically $\theta=36°$) and allowing the device to rotate on stub axle 71, as one spool of ribbon increases in diameter and the other spool of ribbon decreases in diameter, the distal ends 134 and 142 remain in contact with the ribbon while not changing the initial pressure at the point of contact.

It can be seen that the ribbon "cake" on spools 16 and 18 are nestled in the ribon guide 136 between flanges 130 and 132 of arm 126 and in the ribbon guide 144 between flanges 138 and 140 of arm 128 to maintain a constant spacing of the edges of the ribbon from broad faces 11 and 32, and it can also be seen that belt guides 115 of members 100 and 102 and belt guide 129 of arm 126 maintain the center lines of the belt and ribbon in in a common plane relation so that the belt does not "ride" up and down across the surface of the ribbon between the edges thereof.

In operation, drive of belt 70 is effected by the particular drive roller, **46*a* or 46*b*, in engagement with the host printer. Assuming that it is 46*a*, drive would be in the direction of arrow 74, the belt then passing through guide belt opening 114 of alignment end guide device 100, around drive roller 46*b*, which then functions as an idler, back through guide belt opening 114, then over the generally top side of the ribbon on spool 18 and over the distal end 142 and through slot 139 of arm 128, then moving on and around idler 72, through guide belt opening 129 and over the distal end 134 of arm 126 of alignment and guide device 124, then back generally over the top of the ribbon on spool 16 and through slot 114 of alignment guide device 102 to drive roller 46*a*, then back through elongated slot 114 of device 102 and back to roller 46*b*. In terms of FIG. 1, cartridge 10 would lie generally horizontal as one would look down on the cartridge, and the underside (not shown) of drive roller 46*a* would be engaged with the printer. In the case of the Diablo HyType II printer, the underside of roller 46*b*** would be engaged by the printer.

With drive occurring as described in the foregoing (roller **46*a* driving), ribbon 14 would be passing off of the generally rear side of spool 18, then outwardly toward one end side and through ribbon guides 106 of alignment and guide member 100, assuring that ribbon 14 does not engage or rub on belt 70 as the belt travels around roller 46*b*. Ribbon 14 then passes, as shown by arrow 88, on and by guide 80, then over and between guides 20 and 22. Then it passes on and by guide 81 and then through guides 106 of alignment and guide member 102 on the opposite side of cartridge 10, arranged in the same manner as described for alignment and guide member 100 and thence onto spool 16**.

With cartridge 10 turned over, drive roller **46*b* would be in engagement with the printer. Belt 70 would then move in the reverse direction as would ribbon 14. While in view of the positive drive in both directions, hand adjustment of tension of belt 70 or ribbon 14 is not generally necessary, the end region 60 of a drive roller is available as a means of rotating the drive system and is useful in effecting alignment between openings 48** of a drive roller and a host printer.

Referring to cartridge 10 in an operating position, where it is horizontal, a significant portion of half (top or bottom) of ribbon 14 is impacted by the print characters of a printer during travel of ribbon 14 between spools 16 and 18. An arm (not shown) from a host computer extends through the openings 73 of case 10, and when the ribbon has been fully wound from one spool, e.g., spool 16, and wound on the other, e.g., spool 18, this arm operates a switch in the printer to turn the printer off. This signals the operator to turn the cartridge over such that drive roller 46b will engage the drive for the host printer rather than drive roller 46a. The result will be that belt 70 and ribbon 14 will reverse their direction, and the opposite half (top or bottom) of ribbon 14 will be utilized by the printer. Significantly, however, cartridge 10, having an internal belt drive, does not require belt transfer from one side to the other when there is a reversal of operating sides of the cartride as described.

Figure 11:
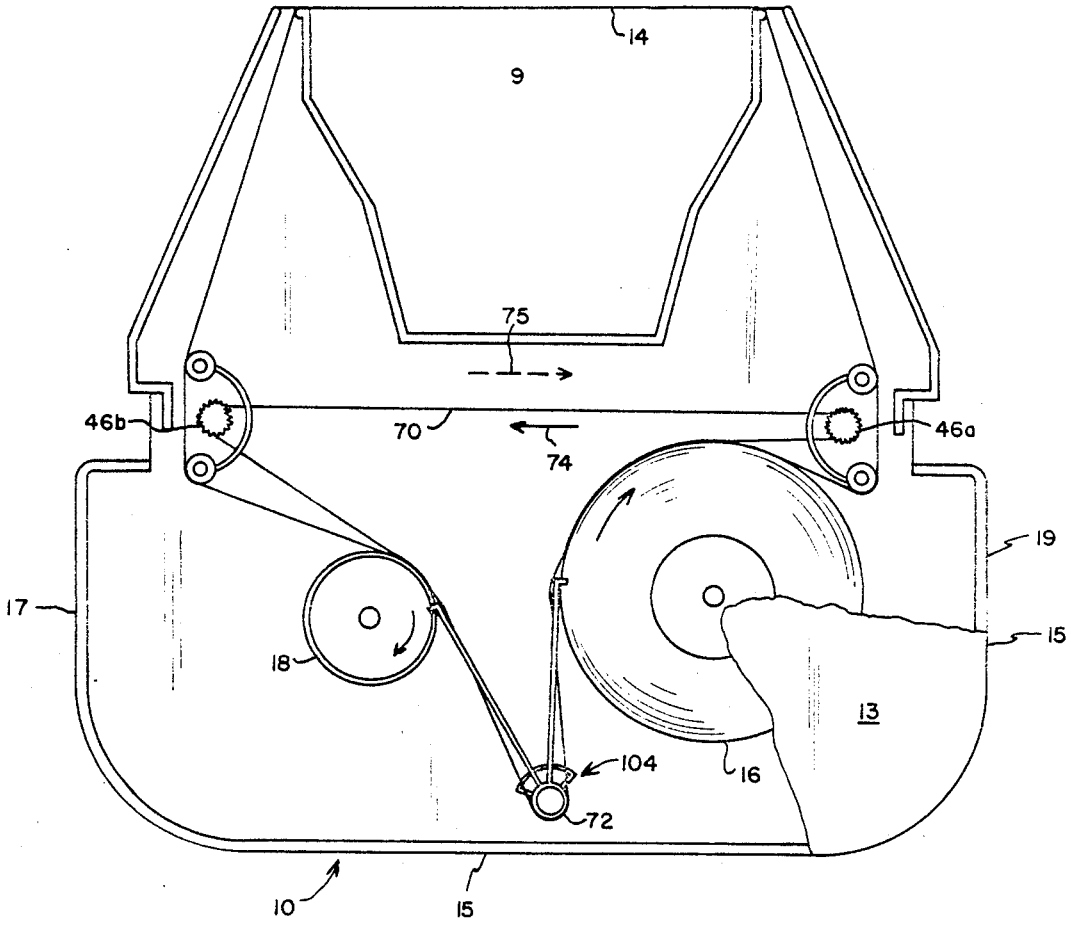
FIG. 11 is a top plan view similar to FIG. 1 with the cartridge having a sightly different configuration and with the drive occurring from the other drive wheel than in FIG. 1 and with the ribbon spools wound in the opposite direction.

FIG. 11 illustrates the alignment and guide devices of FIG. 1 in a different type of cartridge. As shown in FIG. 11, the cartridge is driven by a printer which engages wheel 46b for rotation in a counterclockwise direction. Arrow 74 shows that the belt is also rotated in a counterclockwise direction. It is to be understood, however, that rotation of the belt may occur in the other direction (indicated by arrow 75) as a result of the printer drive shaft rotating clockwise. Belt rotation, and therefore spool rotation, is controlled by the direction in which wheels 46a and 46b are rotated. Such direction of rotation of wheels 46a and 46b is totally dependent on the direction of rotation of the drive shaft of the particular printer in which the cartridge is used. FIG. 11 also illustrates that the ribbon may be wound on the spools in a direction opposite to that shown in FIG. 1.

Figure 12:
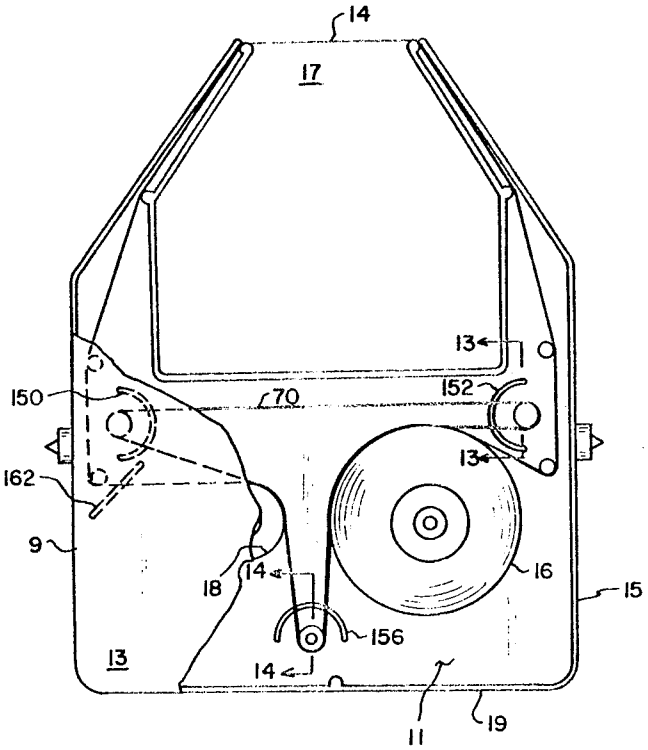
FIG. 12 is a top plan view similar to FIG. 10 illustrating the molded construction of the guide and alignment devices and with the drive occurring from the other drive wheel and the ribbon spools wound in the opposite direction.
Figure 10:
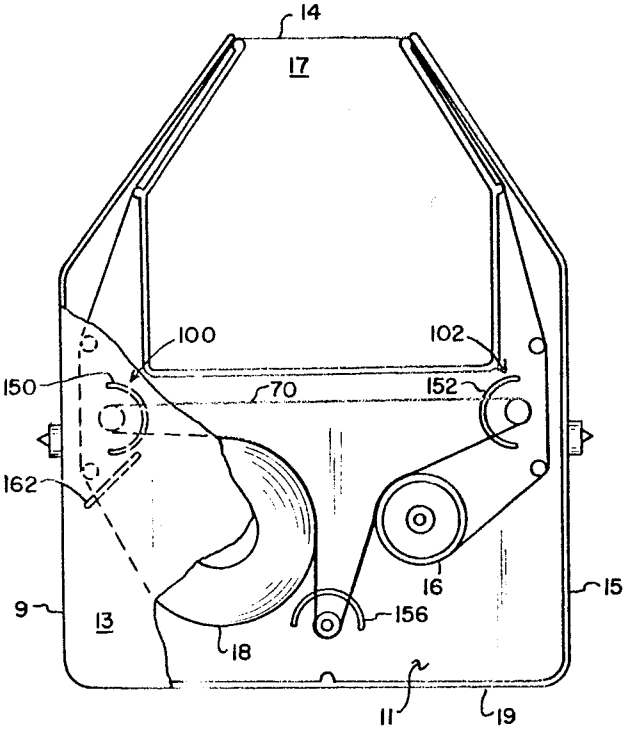
FIG. 10 is a top plan view similar to FIG. 1 illustrating another embodiment in which the guide and alignment devices of the present invention are molded in the case.
Figure 13:
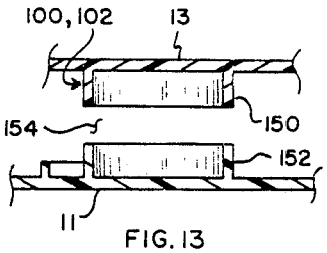
FIG. 13 is a sectional view taken along line 13—13 of FIG. 12.
Figure 14:
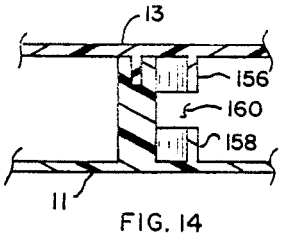
FIG. 14 is a sectional view taken along line 14—14 of FIG. 12.

Another embodiment of the guide and alignment devices is shown in FIGS. 10 and 12, which are plan views of the cartridge and illustrate the different drive directions as illustrated in FIGS. 1 and 11, respectively. However, in this embodiment, the alignment and guide means is molded into the cartridge casing. Guide members 100 and 102 are comprised of upper and lower arcuate sections 150 and 152, respectively (FIG. 13). Upper section 150 is molded to the inner surface of broad side 13, and lower section 152 is molded to the inner surface of broad side 11 of the cartridge. When the upper and lower broad sides are assembled (FIG. 13), a guide space 154 is provided through which the belt travels. In a similar manner, a pair of arcuate sections 156 and 158 are molded in the lower portion of lower and upper broad sides 11 and 13, respectively. When the upper and lower broad sides are assembled (FIG. 14), a guide space 160 is provided through which the belt passes. In the molded embodiment, member 104 is not used since the belt is maintained in alignment by guide spaces 154 of members 100 and 102 and by the space provided between members 156 and 158, which are positioned partially around idler 71.

Figure 15:
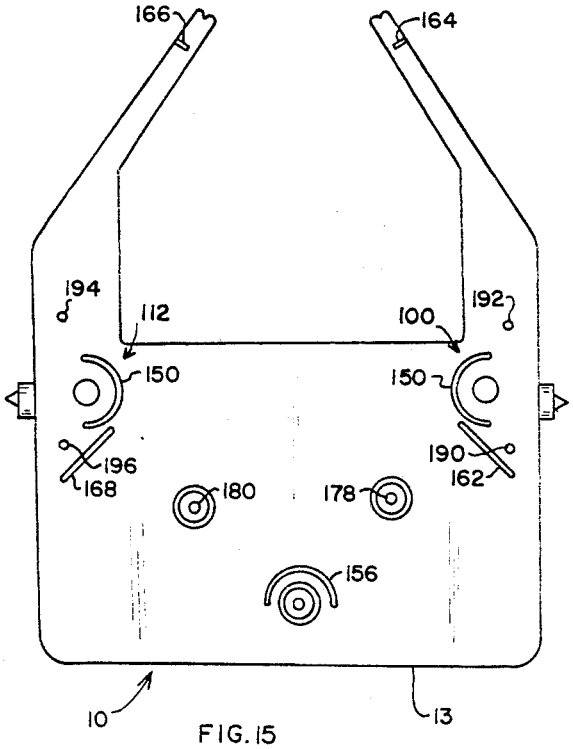
FIG. 15 is a plan view of the upper broad side of the cartridge of the embodiment shown in FIGS. 10 and 12.
Figure 16:
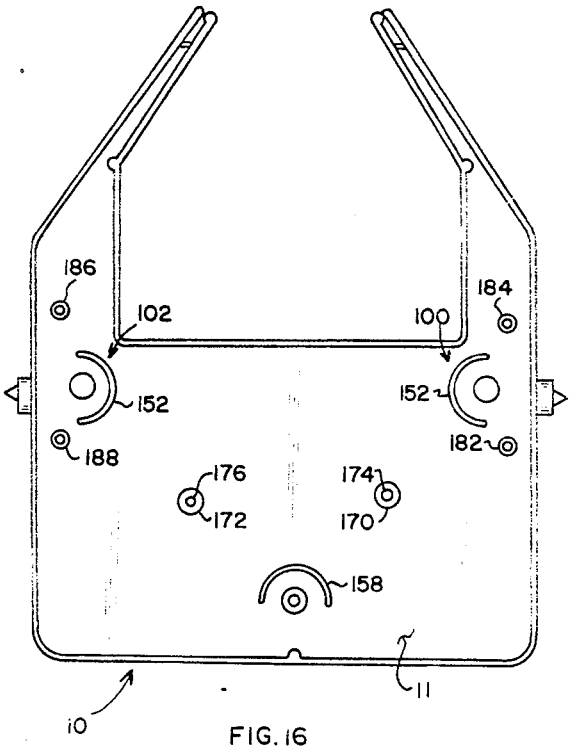
FIG. 16 is a plan view of the lower broad side of the cartridge of the embodiment shown in FIGS. 10 and 12.
Figure 18:
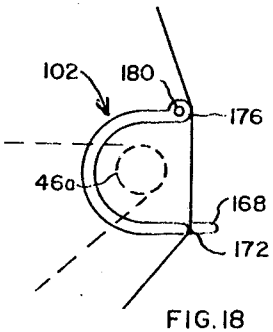
FIG. 18 is an enlarged view of the alignment and guide member of FIG. 17 and more clearly illustrates the position of the belt, ribbon, and drive wheel relative to the alignment and guide member.
Figure 19:
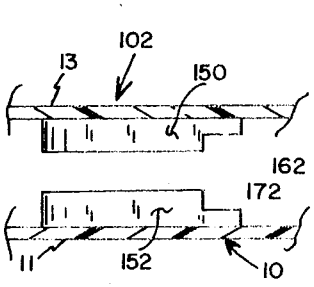
FIG. 19 is a sectional view taken along line 19—19 of FIG. 17.
Figure 20:
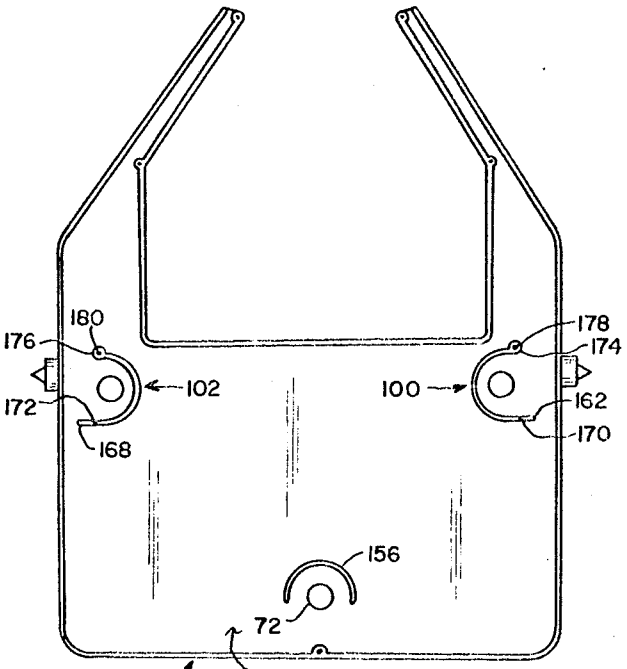
FIG. 20 is a plan view similar to FIG. 15 of the underside of the upper broad side of the cartridge body.
Figure 17:
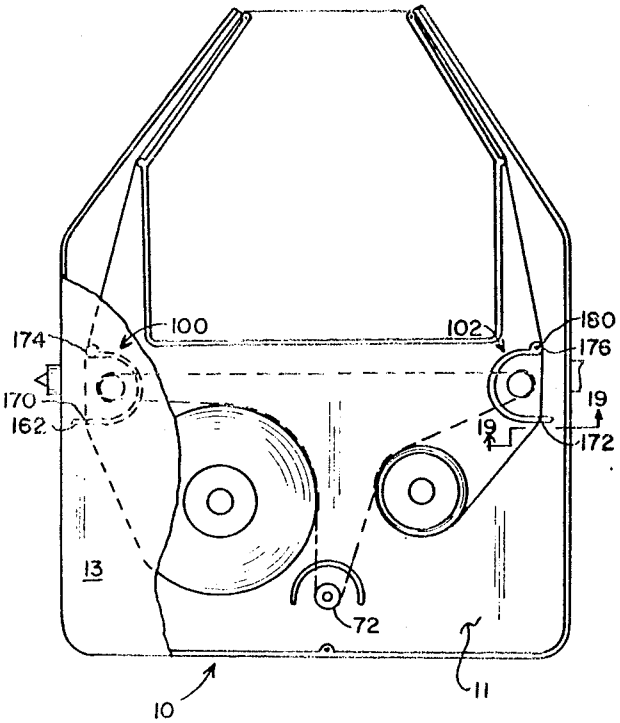
FIG. 17 is a plan view similar to FIG. 10 illustrating another embodiment of the present invention.

FIGS. 15 and 16 are plan views of the upper and lower broad sides of case 10. As seen in FIG. 15, the ribbon is maintained in alignment by raised molded surfaces 162, 164, 166, and 168 provided on the inner surface of upper broad side 13. Members 170 and 172 (FIG. 16) are posts on which the ribbon spools are mounted. The post includes openings 174 and 176 into which pins 178 and 180 (FIG. 15) are inserted for assembly of the upper end. In like manner, guides 182, 184, 186, and 188 of lower broad side 13 (FIG. 16) are mated with pins 190, 192, 194, and 196 of upper broad side 13.

In operation of the cartridge, the belt passes around the drive wheels 46a and 46b and the idler. In its movement, the belt is guided through openings 154 of guide members 100 and 102 and through opening 160, between sections 156 and 158 in its passage around idler 71. The ribbon is maintained in alignment, as it traverses between the spools, by raised surfaces 162, 164, 166, and 168.

A further embodiment is shown in FIGS. 17–20. In this embodiment, the alignment and guide devices are also molded to the cartridge in the manner described in conjunction with the discussion of FIGS. 10–16. However, in this embodiment, raised ribbon guide members 162 and 168 are made integral with members 100 and 102, respectively. As seen in FIGS. 17–20, members 100 and 102 include raised ribbon guide members 162 and 168 extending from the ends 170 and 172 thereof, respectively. Arcuate members 100 and 102 further include guide ends 174 and 176 at their other ends which may be provided with openings 178 and 180 to receive pins projecting from the broad side for securing the sides together.

In operation, the belt passes around the drive wheels 46a and 46b and the idler. In its movement, the belt is guided through openings 154 (FIG. 13) of guide members 100 and 102 and through opening 162 (FIG. 14) between sections 156 and 158 in its passage around idler 71. The ribbon is guided around and engages the ends 170 and 174 of member 100 and ends 170 and 172 of member 102. The ribbon is maintained in alignment with the belt by passing in engagement with raised portions 162 and 168 of members 100 and 102.

While the cartridges have been described as being driven by the printer from the underside, it is to be understood that the cartridge drive wheels may be driven from the top side of the cartridge as well. Additionally, if desired, a portion of either of the sides adjacent the drive wheels may be open to permit a gear on the end of a printer drive shaft or other drive means to engage either of drive wheels 46a and 46b through the open portion provided in the sides of the cartridge for rotation of the selected drive wheel.

By means of the construction disclosed, an optimum belt tension is maintained in belt 70 such that ribbon 14 is always under a degree of tension, but implicitly the tension is below the level at which there is danger of ribbon 14 breaking. This tension would typically be in the range of from one to four ounces.

Of further significance is the fact that belt carrying region 68 of the drive rollers is made cylindrical and is not toothed as in the case of the drive surface of the prior art cartridges referred to above. This change is enabled by virtue of the fact that the drive rollers drive a belt which may be under greater tension than the ribbon. This enables a thinner wall thickness for the drive capstan or drive roller and thus a smaller effective diameter. This in turn enables a reduction in rate of drive imparted to the belt and thus to the ribbon. The result is that there is a reduction of approximately 25% in the rate of ribbon travel. Importantly, it has been found that, despite this reduction, the quality of print is not noticably degraded, and thus in effect a user will achieve an approximately 25% reduction in ribbon usage.

By the foregoing, the applicant has provided a significantly improved reversible drive ribbon cartridge wherein an outer belt is eliminated. Distinctively, the drive belt is placed internally and requires no disassembly and reassembly. Operably, it applies a torque to one ribbon spool in a direction which effects a winding on that spool of the ribbon, which in turn applies a tension to the ribbon across its working station. Thereafter, by virtue of a transmission of tension along the belt, the belt thereafter applies a relaxation of tension to the other ribbon spool. By virtue of this distinct sequence of application of force and relaxation of tension to the ribbon, an ideal tension is maintained at the print station between gides 20 and 22. Also, by the elimination of the toothed portion of the drive roller where it effects drive, the effective diameter of the drive roller is reduced, and thereby a significant increase in usage of ribbon is obtained with the same printer driver. Finally, by the provision of ribbon and belt alignment and guide devices, the center lines of the ribbon and belt are maintained aligned in a common plane relation, thus preventing the belt from sliding across the ribbon surface at the points where the belt and ribbon are in contact and also preventing the outer edges of the ribbon from undesirable frictional contact with the internal surfaces of the top and bottom of the case.

What is claimed is:

1. A ribbon cartridge for a printer having a drive member, and comprising:

a case including broad opposite face sides, front and rear opposite sides, and first and second opposite end sides, said sides defining a cavity, and said case provided at said front side with a pair of spaced guide members;

first and second spaced drive means within said case, said first drive means including a drive roller adapted to be driven from said printer through one said broad side of said case, said second drive means including a drive roller adapted to be driven from said printer through an opposite said broad side of said case, and said drive rollers positioned generally adjacent said end sides of said case, whereby one of said rollers would be driven at a time;

a ribbon carried in said cavity;

ribbon storage and dispensing means disposed in said cavity for storage of said ribbon and for dispensing said ribbon for travel thereof in a prescribed path through an impact region, said ribbon storage and dispensing means comprising first and second spools, said first spool being positioned generally proximate said first drive means, and said second spool being positioned generally proximate said second drive means;

an idler roller positioned inward of said ribbon storage and dispensing means;

a belt extending around said drive rollers and said idler roller for rotation of said drive rollers and for movement in a prescribed path over and in contact with said ribbon on said storage and dispensing means and said idler; and alignment and guide means carried in said cavity for aligning the center line of said belt and said ribbon in a common plane and for limiting movement of said drive belt and said ribbon in a direction normal to said common plane, said alignment and guide means including a first and second alignment and guide member respectively positioned in spaced relation in said case generally adjacent said first and second opposite end sides and disposed for guiding said ribbon in spaced relation past said drive rollers and between said pair of spaced guide members while simultaneously guiding said belt around said drive rollers and said idler roller and while maintaining the center lines of said ribbon and said belt in alignment.

2. A ribbon cartridge for a printer as set forth in claim 1 wherein said alignment and guide means further includes a third alignment and guide member carried by said idler roller in cooperating relation with said first and second guide members to maintain the center line of said belt and said ribbon is aligned relation while maintaining said edges of said ribbon in spaced relation with said broad sides of said case.

3. A ribbon cartridge for a printer as set forth in claim 2 wherein said first and second alignment and guide members include a pair of spaced hollow posts having spaced flange surfaces thereon defining ribbon guides and an arcuate portion connecting said posts, said arcuate portion having an elongated slot therein defining a belt guide, the center line of said elongated slot and said ribbon guides being coincident.

4. A ribbon cartridge for a printer as set forth in claim 3 wherein said idler roller is mounted on an idler support arm, and said third alignment and guide member includes a body having an opening therein for receiving said idler support arm therein and first and second arms radially extending from said body, each said radially extending arms having spaced flanged surfaces on the distal ends thereof defining a ribbon retainer and guide.

5. A ribbon cartridge for a printer as set forth in claim 4 wherein said first radially extending arm includes an elongated slot defining a belt guide having the center line thereof coincident with the center line of said ribbon guide of said first radially extending arm.

6. A ribbon cartridge for a printer having a drive member, and comprising:

a case including broad opposite face sides, front and rear opposite sides, and first and second opposite end sides, said sides defining a cavity, and said case provided at said front side with a pair of spaced guide members;

first and second spaced drive means within said case, said first drive means including a drive roller adapted to be driven from said printer through one said broad side of said case, said second drive means including a drive roller adapted to be driven from said printer through an opposite said broad side of said case, and said drive rollers positioned generally adjacent said end sides of said case, whereby one of said rollers would be driven at a time;

a ribbon carried in said cavity;

ribbon storage and dispensing means disposed in said cavity for storage of said ribbon and for dispensing said ribbon for travel thereof in a prescribed path through an impact region, said ribbon storage and dispensing means comprising first and second spools, said first spool being positioned generally proximate said first drive means, and said second spool being positioned generally proximate said second drive means;

an idler roller positioned inward of said ribbon storage and dispensing means;

a belt extending around said drive rollers and said idler roller for rotation of said drive rollers and for movement in a prescribed path over and in contact with said ribbon on said storage and dispensing means and said idler; and alignment and guide means carried in said cavity for aligning the center line of said belt and said ribbon in a common plane and for limiting movement of said drive belt and said ribbon in a direction normal to said common plane, said alignment and guide means disposed for guiding said ribbon in spaced relation past said drive rollers while simultaneously guiding said belt around and in contact with said drive rollers and said idler roller, said alignment and guide means comprising a first and second belt alignment and guide member respectively positioned in spaced relation in said case generally adjacent said first and second opposite end sides, and a third belt alignment and guide member positioned in said case adjacent said rear opposite side, said first, second, and third belt alignment and guide members comprised of upper and lower spaced sections molded to said case.

7. A ribbon cartridge as set forth in claim 6 wherein said alignment and guide means further includes a first and second ribbon guide means respectively positioned in spaced relation in said case generally adjacent said first and second opposite end sides, said first and second ribbon guide means comprising a raised surface molded on the upper of said broad opposite face sides.

8. A ribbon cartridge as set forth in claim 7 wherein said belt guide means is comprised of said upper and lower members provided with an arcuate configuration, said upper member having said raised molded surface extending from a distal end thereof for forming said ribbon alignment and guide means.

9. A ribbon cartridge as set forth in claim 7 wherein said alignment and guide means further includes third and fourth ribbon and guide means respectively positioned in spaced relation in said case generally adjacent said front opposite side, said third and fourth alignment and guide means comprising a raised surface molded on the upper of said broad opposite face sides.

* * * * *